United States Patent [19]

Neumeier

[11] Patent Number: 4,736,281

[45] Date of Patent: Apr. 5, 1988

[54] CLOSURE HEAD OF A GAS BALLOON

[76] Inventor: Robert Neumeier, Weissachaustr. 21, D-8183 Rottach-Egern, Fed. Rep. of Germany

[21] Appl. No.: 910,219

[22] PCT Filed: Mar. 6, 1986

[86] PCT No.: PCT/DE86/00090

§ 371 Date: Jun. 24, 1986

§ 102(e) Date: Jun. 24, 1986

[87] PCT Pub. No.: WO86/05255

PCT Pub. Date: Sep. 12, 1986

[30] Foreign Application Priority Data

Mar. 8, 1985 [DE] Fed. Rep. of Germany ... 8506853[U]

[51] Int. Cl.[4] ..... F21L 9/00

[52] U.S. Cl. ..... 362/186; 116/210; 446/220; 362/320

[58] Field of Search ..... 362/220, 320, 186; 446/219, 220, 222, 224; 116/210, DIG. 9; 137/512, 224, 318; 141/4, 7, 10, 114, 66, 67, 243, 329

[56] References Cited

U.S. PATENT DOCUMENTS

| | | | |
|---|---|---|---|
| 1,355,230 | 10/1920 | Kaiser | 137/512 |
| 3,253,137 | 5/1966 | Richter | 362/248 |
| 3,592,157 | 7/1971 | Schwartz | 362/387 |
| 3,812,878 | 5/1974 | Bird et al. | 137/512 |

*Primary Examiner*—James C. Yeung
*Assistant Examiner*—Noah Kamen
*Attorney, Agent, or Firm*—Price, Gess & Ubell

[57] ABSTRACT

A balloon closure head for mounting a balloon and a lamp for illuminating the balloon, as well as apparatus for conducting air to inflate and deflate the balloon and apparatus for conducting electricity to the lamp. The conducting apparatus employs needle nose piercing elements which pierce supply channels for both gas and electricity carried by rectangular conduits sealably clamped to the closure head. In one embodiment, a single pair of conductive hollow needle nose piercing elements and cooperating non-return valves supply both gas for the balloon and electricity for the lamp.

5 Claims, 2 Drawing Sheets

CLOSURE HEAD OF A GAS BALLOON

BACKGROUND OF THE DISCLOSURE

1. Field of the Invention

The invention relates generally to a closure head for a gas balloon, and more particularly, to a closure head intended for strings of air balloons having associated closure heads connected to a common supply cable along which the balloons are distributed at intervals from one another. The supply cable may include a pneumatic supply line for inflation of the air balloon, a pneumatic return line for deflation of the air balloon, electrical supply conductors for an electric lamp disposed in the closure head and intended for internal illumination of the air balloon and/or electrical supply conductors for a sound radiator such as a loudspeaker disposed in the closure head.

2. Description of Related Art

In the prior art, closure heads employing electrical lamps for illuminating air balloons are known. In such devices, the electrical lamp is screwed into a lamp socket to which conductor wires are connected. The conductor wires are led in vacuum-tight fashion out of the closure head on the side which is remote from the lamp socket and are connected to electrical terminals disposed on the outside of the closure head for connection to a cable leading to an external current source. It is also known per se to provide electric lamp sockets for incandescent lamps with electrical connections which take the form of piercing contact elements so that the lamp socket can be clamped onto a two-core flat cable establishing electrical contact between the piercing contact connections of the lamp socket and the conductor cores within the flat cable.

SUMMARY OF THE INVENTION

According to the invention, a closure head for a gas balloon is provided which can be fixed directly to a supply cable. A supply cable including first and second pneumatic channels is sealably introduced by a clamping means into the interior of the closure head housing, one end of which is adapted to mount the balloon. First and second check valves employing hollow needle tips are arranged to communicate with the first and second channels in order to inflate and deflate the balloon. According to an additional feature of the invention, the first and second needle tips may contact first and second electrical conductors in order to activate a lamp for illuminating the balloon. Alternatively, a second cable carrying electrical conductors may be mounted adjacent the supply cable and additional piercing elements arranged to contact the electrical conductors.

The invention has the advantage that the closure head may accommodate an electric lamp for internal illumination of the air balloon and/or a sound irradiator, which are coupled via associated piercing elements to the associated supply lines, the particular associated piercing element in the housing being connected to an electrical conductor which leads to the associated connection of the relevant energy irradiator.

Additionally, the direction of closure of the check valves are advantageously directed in opposition to one another. As a result, it is possible to inflate the gas balloon using the first check valve, which is maintained closed by the pressure inside the gas balloon after inflation. In consequence, the inflated balloon cannot be deflated through the associated pneumatic supply line if, for example, another gas balloon in the chain happens to burst. With respect to the second check valve, it is possible to maintain a holding pressure via the associated supply line of the cable which maintains the second check valve closed against the internal pressure of the inflated balloon. If there is a need for the gas balloon to be deflated, the supply line associated with the second check valve may be vented, so that the associated check valve opens under the pressure inside the gas balloon. Such operation may be advantageous, for instance, when a string of gas balloons is suspended in a garden and a strong wind blows up which might cause the inflated gas balloons to burst, due to the large surface area which they offer when inflated. In such case, it is possible to deflate the gas balloons in the string to avoid damage thereto.

BRIEF DESCRIPTION OF THE DRAWINGS

The invention will be explained with reference to preferred embodiments which are evident from the accompanying drawings of which.

DETAILED DESCRIPTION OF THE PREFERRED EMBODIMENTS

Figure 1:
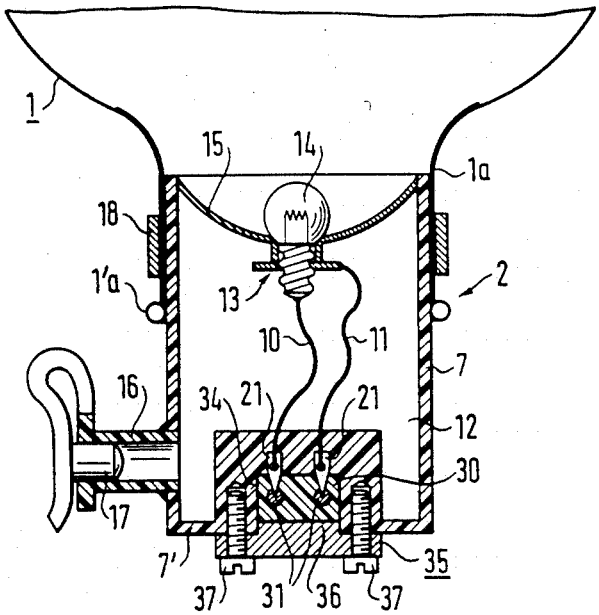
FIG. 1 is a longitudinal section of a closure head with an electric lamp for internal illumination of the air balloon.

In all the embodiments, the closure head 2 comprises a hollow cylindrical housing 7 made from synthetic plastic material. One end of the housing 7 is closed in gas-tight fashion by an end wall 7' while the other end of the housing 7 is open. The open housing end of the closure head 2 is introduced into the balloon neck 1*a* of an inflatable air balloon 1 so that the marginal bead 1'*a* of the balloon neck 1*a* of the air balloon 1 fits closely around the outer peripheral surface of the housing 7 and such that the part of the balloon neck 1a which abuts the marginal bead 1'*a* fits closely against the outer peripheral surface of the open end of housing. In addition, a clamping ring 18 may be provided encircling the balloon neck 1*a*.

In the open end of the housing 7, there is a lamp socket 13 for an electric lamp 14 designed to run on mains or battery supply for internal illumination of the air balloon. The light irradiated by the bulb is reflected into the air balloon by means of a reflector 15. The lamp socket 13 is connected by electrical connecting wires 10, 11 to electrical connecting contacts which are available at the closed housing end 7' for connection to the electrical conductors 31 of a power supply cable 30. For this purpose, the connecting contact elements are constructed as piercing elements, e.g. 20, 21, 23, which are adapted to pierce the supply cable until they come into contact with the associated electrical supply conductor 31. The supply cable 30 is of rectangular cross-section and comprises two electrical conductor cores which extend parallel from each other and are spaced apart by a selected distance. To establish the location of the supply cable 30, there is constructed in the closed head end 7' of the housing 7 a cable housing groove 34, the dimensions of which conform to those of the supply cable 30. The piercing connecting elements 20, 21 or 23 protrude into the cable receiving groove at intervals which correspond to the distance between the electrical conductors 31. The supply cable 30 is pressed into the cable housing groove 34 and onto the piercing elements 20, 21, 23, by a clamping device comprising a clamping plate 35 fastened by two slot-headed screws 37 to the closed head end 7' of the housing 7.

Figure 2:
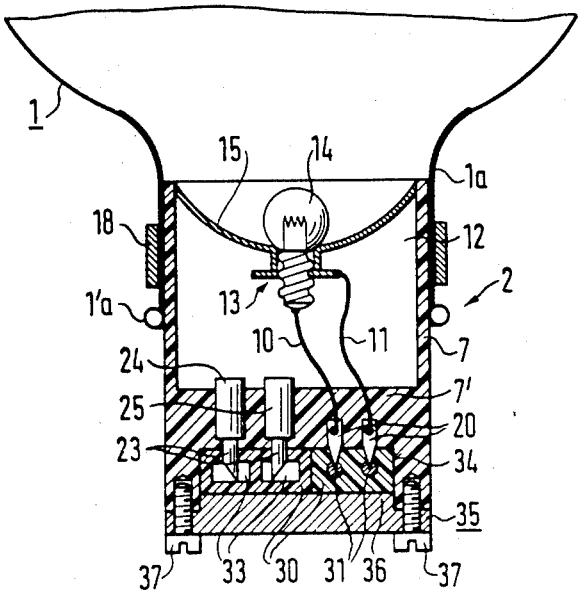
FIG. 2 is a longitudinal section of a closure head wherein a supply cable with pneumatic lines is provided for inflating or deflating the air balloon.
Figure 4:
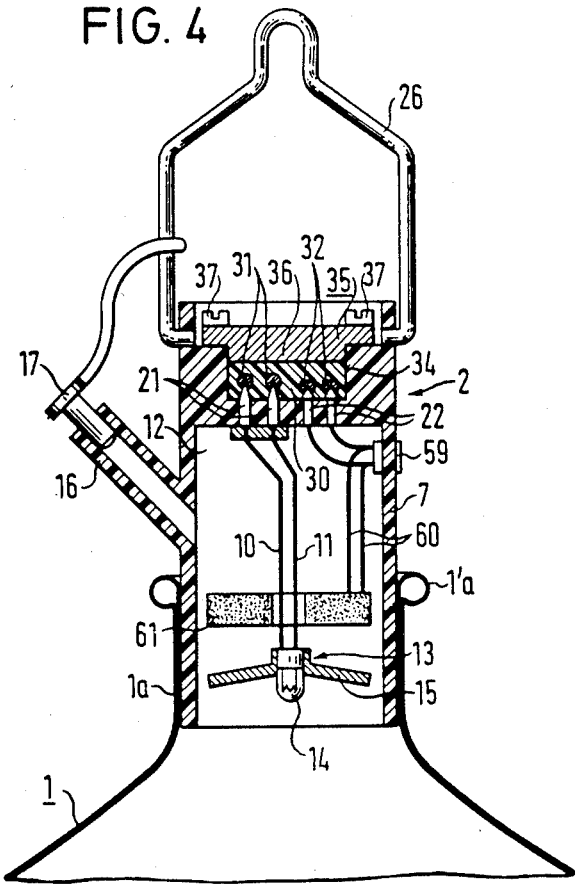
FIG. 4 is a longitudinal section of a closure head wherein a sound irradiator is additionally mounted in the closure head.

As may be seen in FIGS. 1, 2 and 4, the clamping plate 35 has a clamping projection 36 which fits into the open end of the cable housing groove 34 and rests against the supply cable 30.

In the embodiment of FIG. 1, the piercing elements are constructed as piercing tongues 20. In addition, an air inlet 16 is mounted on the housing 7 and arranged to discharge into the interior thereof. The air inlet 16 can be closed by a closure plug 17 in order to inflate or deflate the air balloon 1 through the hollow housing 7. To this end, air through flow apertures (not shown) are constructed in the reflector 15.

In the embodiment of FIG. 2, a pressure air supply cable 30*a* is inserted into the cable housing groove 34, in addition to the power supply cable 30. The cable housing groove 34 is wider than that shown in FIG. 1 in order to accommodate both the air supply cable 30*a* and power supply cable 30. The air supply cable 30*a* may be connected to or separate from the power supply cable 30 and includes two adjacently disposed air lines 33. Disposed on the bottom of the cable housing groove 34 and projecting into the groove 34 are two hollow needles 23, which can be pushed into pressure air lines 33. The hollow needles 23 discharge through a respective check valve 24, 25 located in the interior 12 of the housing 7. One check valve 24 opens in the direction of the interior 12 of the housing 7, while the other check valve 25 closes towards the interior 12 of the housing 7. One of the hollow needles 23 and its associated check valve 24 serve to supply compressed air for inflating the air balloon 1 through the associated pressure air line 33. The check valve 24 is provided to prevent collapse of the air balloon 1 in the event that pressure in the associated pressure air passage 33 should drop. The other hollow needle 23 and its associated check valve 25 is used for controlled deflation of the air balloon 1. As long as it is intended that the air balloon 1 remain filled, the check valve 25 is maintained in the closed position by a holding pressure in the associated air line 33. If it is desired to deflate the air balloon 1, the holding pressure is removed, causing the check valve 25 to open under the pressure inside the air balloon. The balloon then deflates through the open check valve 25, the associated hollow needle 23, and the associated air line 33. The hollow needles 23 could alternating comprise hose nipples or the like.

Figure 3:
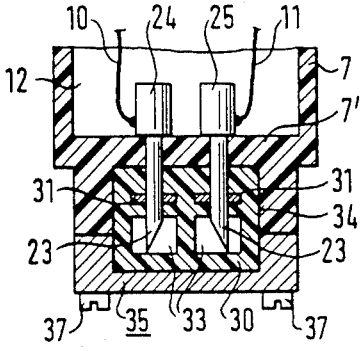
FIG. 3 illustrates a modified embodiment of the closure head shown in FIG. 2.

In the embodiment shown in FIG. 3, the supply cable 30a again includes two pressure air lines 33. In addition, two flat electrical conductors 31 are disposed above the air lines 33. Two metallic hollow needles 23 pierce the supply cable 30 and penetrate through the associated flat conductor 31 so that their open ends penetrate into the associated pressure air line 33. The electrical connecting wires 10, 11 which lead to the lamp socket 13 (not shown in FIG. 3) are respectively soldered to the metallic housing of the check valves 24, 25, which contact a respective hollow needle 23. The air transmission function of the check valves 24, 25 of FIG. 3 corresponds to that of the check valves 24, 25, of the embodiment of FIG. 2. Therefore, the hollow needles 23 of FIG. 3 serve both as electrical contacts for supplying power to the lamp 14 and as conduits for filling and emptying the air balloon 1.

According to FIG. 4, the closure head 2 can be suspended from a hanger 26 fitted on the closed end of the closure head 2. Furthermore, in the embodiment of FIG. 4, a sound irradiator 61 is disposed in the interior 12 of the housing 7. The electrical leads 60 of the sound irradiator 61 extend to a plug contact 59 located on the side of closure head 2. In addition, piercing pins 22 exttend out of the closed end of the housing, their tips penetrating into the cable housing groove 34 which carries the supply cable 30. In addition to the two current supply lines 31 for the lamp 14, the supply cable 30 has two flat electrical conductors 32 for supplying the sound irradiator 61. Thus, when the supply cable 30 is pressed into the cable housing groove 34, the conductors 31 for the lamp 14 are in electrical contact with piercing pins 21 to which the conductor wires 10, 11, for the lamp 14 are connected, while the flat conductors 32 are in electrical contact with the piercing pins 22 which supply power to the sound irradiator 61.

What is claimed is:

1. A closure head for a gas balloon comprising:

a housing means having a first end adapted for sealably mounting the neck of a balloon and introducing gas into said balloon;

first and second pneumatic lines;

means for sealably introducing said first and second pneumatic lines into said housing means;

a first check valve means within said housing means including a first hollow needle tip for communicating with and conducting gas from said first pneumatic line into said housing means for inflating said balloon and having a first direction of closure;

a second check valve means within said housing means including a second hollow needle tip for communicating with and conducting gas from said second pneumatic line and out of said housing means and having a direction of closure opposite to that of said first check valve means; and wherein said first and second pneumatic lines comprise respective first and second channels within a supply cable and wherein said means for sealably introducing includes a clamping means or sealably engaging said housing means.

2. The closure head of claim 1 wherein said first hollow needle tip and second hollow needle tip pierce said supply cable and respectively enter said first and second channels.

3. The closure head of claim 2 wherein said first and second hollow needle tips are formed of conductive material and further including:

first and second electrical conductors respectively pierced through by said first and second needle tips prior to entry of said first and second needle tips into said first and second channels, respectively;

electrical conductor means connected to said first and second hollow needle tips; and lamp means connected to said electrical conductor means for activation thereby.

4. The closure head of claim 2 further including:

a second cable mounted adjacent to said supply cable and sealably positioned with respect to said housing means by said clamping means, said second cable including first and second electrical conductors; and first and second piercing elements penetrating said cable and respectively contacting said first and second electrical conductors.

5. The closure head of claim 4 wherein each of said second and supply cables is of rectangular cross section and said clamping means comprises a flat plate fastened against each of said second and supply cables.

* * * * *

UNITED STATES PATENT AND TRADEMARK OFFICE

CERTIFICATE OF CORRECTION

PATENT NO. : 4,736,281

DATED : April 5, 1988

INVENTOR(S) : Robert Neumeier

It is certified that error appears in the above-identified patent and that said Letters Patent is hereby corrected as shown below:

On the Cover Sheet, in the Abstract, line 10, delete "non-return" and insert --check-- therefor.

Column 3, line 66, delete "housing" and insert --housings--

Column 4, line 13, delete "exttend" and insert --extend--

Column 4, line 48, delete "or" and insert --for-- therefor.

Signed and Sealed this

Fifteenth Day of November, 1988

*Attest:*

DONALD J. QUIGG

*Attesting Officer*

*Commissioner of Patents and Trademarks*